US006386779B1

(12) United States Patent
Davis

(10) Patent No.: US 6,386,779 B1
(45) Date of Patent: May 14, 2002

(54) BRUSH-N-GO

(75) Inventor: Michael Davis, Box 254, Petrolia, TX (US) 76377

(73) Assignee: Michael Davis, Petrolia, TX (US)

( * ) Notice: Subject to any disclaimer, the term of this patent is extended or adjusted under 35 U.S.C. 154(b) by 0 days.

(21) Appl. No.: 09/866,333

(22) Filed: May 25, 2001

Related U.S. Application Data

(60) Provisional application No. 60/227,261, filed on Aug. 24, 2000.

(51) Int. Cl.[7] ..... B43K 5/06

(52) U.S. Cl. ..... 401/175; 401/277; 401/270

(58) Field of Search ..... 401/175, 270, 401/277, 272, 273, 278, 279, 174, 172, 173

(56) References Cited

U.S. PATENT DOCUMENTS 1,256,142 A * 2/1918 Lamb ..... 401/272
4,655,627 A * 4/1987 Bradley ..... 401/175
5,066,155 A * 11/1991 English et al. ..... 401/175
5,908,257 A * 6/1999 Martin ..... 401/175
5,913,632 A * 6/1999 Persad ..... 401/175
6,009,886 A * 1/2000 Labranche et al. ..... 401/175

* cited by examiner

*Primary Examiner*—David J. Walczak

(57) ABSTRACT

Brush-n-go is the first all in one toothbrush, that can be used away from home as well as at home. This disposable toothbrush is designed to be used many times before replacement is needed. The handle size of the toothbrush will determine the longevity of each toothbrush. My invention is a toothbrush and toothpaste all in one. The toothpaste for this toothbrush will be concealed in the handle. A one way valve will release the toothpaste into the brushes of this toothbrush. Opposite the brush end of the brush-n-go their will be a twist knob to regulate the need of toothpaste, per each use. Simply twist the knob and the toothpaste will be forced out the one way valve into the brushes of the brush-n-go. After use just clean brushes with water and the brush-n-go will be ready to go.

1 Claim, 3 Drawing Sheets

BRUSH-N-GO

CROSS REFERENCE

A provisional application has been previously filed on; Filing date: Aug. 24, 2000 Application No. 60/227,261.

BACKGROUND OF THE INVENTION

1. Field of the Invention

This invention is related to a toothbrush and in particular a disposable yet reusable toothbrush which consist of a toothbrush and toothpaste all in one.

2. Description of the Prior Art

It has been found that the conventional toothbrush is used primarily in the home. However with a toothbrush and toothpaste all in one, users will have more opportunities to brush outside of said home.

Therefore, it is the object of the present invention to provide a disposable yet convenient toothbrush and toothpaste all in one.

SUMMARY OF THE INVENTION

This invention is related to a toothbrush and in particular a disposable yet reusable toothbrush which consist of a toothbrush and toothpaste all in one.

According to a preferred embodiment of the present invention, a disposable yet reusable toothbrush which consist of a toothbrush and toothpaste all in one, includes a head provided with bristles with an opening in the center of the head at a front end of handle, An elongated tubular handle with the cavity of said handle having a circular hole aligned attaching to the bristle head opening, A one way valve located at the base of the bristle head circular opening, A male threaded rod aligned in the cavity of said handle, A base plate located opposite end of said head, A twist knob located at handles end attached to threaded rod in said handle, Whereby toothpaste can be regulated in the toothbrush handle for use as desired.

The foregoing objects and summary provide only a brief introduction to the present invention. To fully appreciate these and other objects of the present invention as well as the invention itself, all of which will become apparent to those skilled in the art. The following detailed description of the invention and claims should be read in conjunction with the accompanying drawings. Throughout the specifications and drawings identical reference numbers refer to identical or similar parts. Many other advantages and features of the present invention will become manifest to those versed in the art, upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
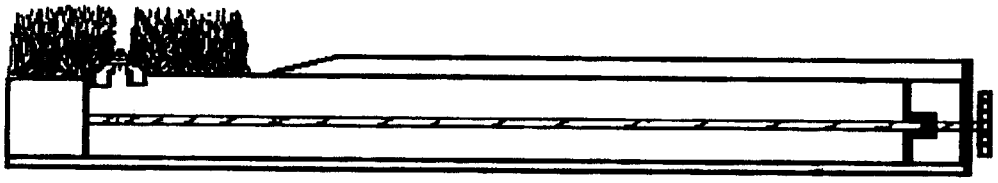
FIG. 1 Is a perspective view of the present invention.
Figure 2:
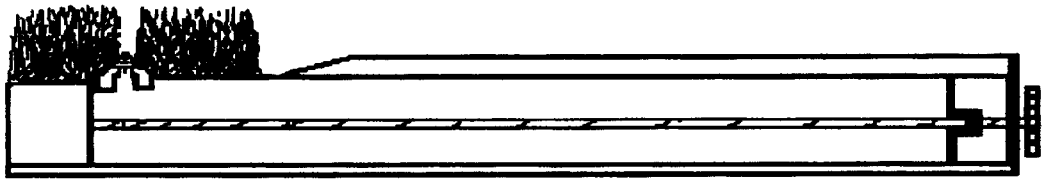
FIG. 2 Is an enlarged view of the present invention.
Figure 3:
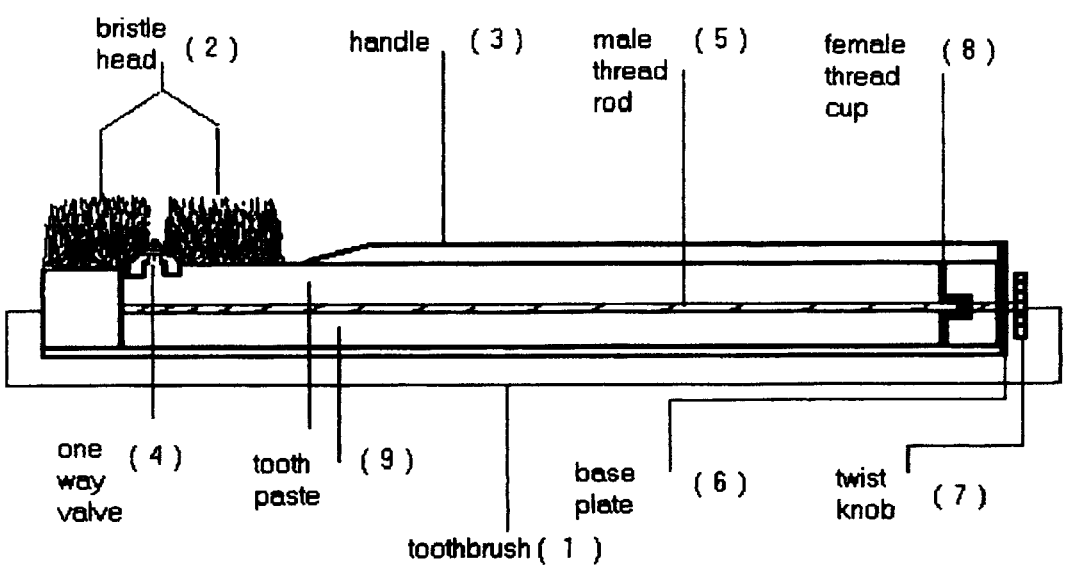
FIG. 3 Illustrates the working principle of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates. With reference to the drawings and in particular to FIG. 3 therefore, toothbrush 1 according to the present invention generally comprises a bristle head 2, a handle 3, a one way valve 4, a male threaded rod 5, a base plate 6, a knob 7 a female threaded rotator cup 8, and toothpaste 9. The head 2 is provided with bristles, with the base of the head having an opening enabling toothpaste 9 to be released into the bristle head 2. The handle 3 is an elongated tubular member having a hollow cavity. The one way valve 4 is located at the base of said head 2. The threaded rod 5 is in conjunction with the base plate 6 as well as the knob 7. The rotator cup 8 rotates on rod 5, when the knob 7 is turned. The toothpaste 9 is located inside the cavity of handle 3.

In assembly, the handle 3, will be filled with toothpaste 9. Thereafter the male threaded rod 5, the base plate 6 and the knob 7, will be sealed opposite end of the toothbrush head 2. The base plate 6 is stationary so that when the knob 7 is turned the male threaded rod 5, will turn as well. The rotator cup 8, will rotate down the rod 5, as the knob 7, is turned. The cup 8, will force the toothpaste 9, out the one way valve 4, into the bristle head 2.

It will be understood that each of the elements described above, or two or more together, may also find a useful application in other types of methods differing from the type described above.

While certain novel features of this invention have been shown and described and are pointed out in the annexed claim, it is not intended to be limited to the details above. Since it will be understood that various omissions, modifications, substitutions, and changes in the forms, and details of the device illustrated and in its operation can be made by those skilled in the art, without departing in any way, from and spirit of the present invention.

I claim:

1. A disposable reusable toothbrush comprising:

a handle comprising a tubular member having first and seconds ends and having a hollow cavity therein, said hollow cavity extending along a longitudinal axis and adapted to hold toothpaste therein, said hollow cavity further having first and second ends wherein said cavity has a substantially constant width throughout a length thereof and extends from said first end of said handle to said second end of said handle;

bristles mounted on said first end of said handle wherein said bristles extend substantially perpendicularly with respect to said longitudinal axis, said cavity extending under a portion of said bristles;

a one way valve positioned on said handle and adjacent said first end of said cavity for enabling the toothpaste to flow from said cavity to said bristles;

a base plate sealed to said second end of said handle for enclosing said cavity;

a threaded rod extending from adjacent said first end of cavity and through said base plate;

a threaded rotator cup threadedly engaged with said threaded rod; and a twist knob positioned adjacent said base plate and engaged with an end of said threaded rod whereby, when said twist knob is rotated by a user, said threaded rod rotates to thereby advance said rotator cup which enables the toothpaste to pass from said cavity, through said one-way valve and onto said bristles and whereby said rotator cup can advance through said cavity such that it can be positioned under a portion of said bristles.

* * * * *